United States Patent [19]

Scinta et al.

[11] Patent Number: 4,599,161

[45] Date of Patent: Jul. 8, 1986

[54] RETORTING PROCESS WITH CONTAMINANT REMOVAL

[75] Inventors: James Scinta; Arlo J. Moffat, both of Bartlesville, Okla.

[73] Assignee: Phillips Petroleum Company, Bartlesville, Okla.

[21] Appl. No.: 678,921

[22] Filed: Nov. 30, 1984

[51] Int. Cl.[4] ..... C10G 1/00; C01B 17/02

[52] U.S. Cl. ..... 201/16; 423/230; 423/244; 201/20; 201/29; 201/34; 201/36; 201/45; 208/408; 208/413

[58] Field of Search ..... 208/8 R, 11 R; 423/230, 423/244 A, 244 R

[56] References Cited

U.S. PATENT DOCUMENTS

| | | | |
|---|---|---|---|
| 2,747,968 | 5/1956 | Pigache | 423/230 |
| 3,247,092 | 4/1966 | Huntington | 208/8 R |
| 4,069,132 | 1/1978 | Deering | 208/11 R |
| 4,088,736 | 5/1978 | Courty et al. | 423/230 |
| 4,092,128 | 5/1978 | Harris et al. | 48/197 R |
| 4,140,181 | 2/1979 | Ridley et al. | 423/244 A |
| 4,164,544 | 8/1979 | Olsson et al. | 423/230 |
| 4,313,820 | 2/1982 | Farha, Jr. et al. | 208/213 |
| 4,374,105 | 2/1983 | Anderson et al. | 423/244 R |

FOREIGN PATENT DOCUMENTS

| | | | |
|---|---|---|---|
| 0061926 | 5/1980 | Japan | 423/230 |
| 0091723 | 6/1982 | Japan | 423/230 |

*Primary Examiner*—Andrew H. Metz
*Assistant Examiner*—Glenn A. Caldarola
*Attorney, Agent, or Firm*—R. C. Lutton

[57] ABSTRACT

Hydrogen sulfide issuing from an oil shale retort is captured in an absorbent bed. When the bed is regenerated as with oxygen containing gas, the sulfur dioxide liberated is reintroduced into the retort for reaction with the spent shale.

7 Claims, 1 Drawing Figure

RETORTING PROCESS WITH CONTAMINANT REMOVAL

BACKGROUND OF THE INVENTION

In one aspect, the invention relates to a process for abating sulfur emissions. in another aspect, the invention relates to sulfur abatement from and other improvements to a retorting operation. In yet another aspect, the invention relates to an improved retorting unit.

Oil shales with high sulfur content produce large quantities of hydrogen sulfide upon pyrolysis and large quantities of sulfur dioxide upon combustion of residual carbon. Converting these gaseous sulfur compounds to solids which can be disposed of in an environmentally sound manner would be very desirable.

A portion of the carbon contained in the kerogen of the shale is generally not converted to upgraded liquid or gaseous product during the pyrolysis step. This residual carbon is typically combusted with oxygen to provide process heat. A process to provide for increased carbon recovery in the form of combustible liquid or gaseous products would be very desirable.

OBJECTS OF THE INVENTION

One object of the invention is to provide a process for returning the sulfur to the spent shale in an oil shale retorting operation.

Another object of the invention is to increase the carbon recovery in the retorting operation to provide for higher process efficiency.

Yet another object of this invention is to provide an apparatus well adapted for returning the sulfur to the spent shale and increasing carbon recovery to higher levels than in prior art processes.

STATEMENT OF THE INVENTION

In one aspect of the invention, a reactor effluent containing hydrogen sulfide is circulated into contact with an absorbing composition which removes the $H_2S$ from the effluent. The absorbing composition can periodically be regenerated by contact with an oxygen containing gas to liberate sulfur dioxide. The sulfur dioxide thus liberated can be circulated back into the reactor to form a solid reaction product which can be withdrawn and properly disposed of. Where the reactor is a retort for conducting the retorting of oil shale, the effluent gas will contain hydrogen in addition to hydrocarbons and $H_2S$. By selecting a zinc titanate as the absorbing composition, unsaturated compounds in the effluent will become hydrogenated thus raising the hydrogen/carbon ratio in the effluent as well as reducing the concentration of hydrogen sulfide.

In another aspect of the invention, an apparatus comprises a means for retorting oil shale to produce an effluent containing hydrogen sulfide. The apparatus is provided with a means for absorbing hydrogen sulfide on a particulate support material and a conduit means connecting an outlet near the first end of the retort with the absorber for conveying the $H_2S$-containing effluent from the retort to the absorber. The apparatus further comprises a desorber for desorbing an off-gas containing $SO_2$ from absorbent previously having absorbed $H_2S$. A conduit means connects the desorber with an inlet near the second end of the retort. A source of oxygen containing gas is connected to the desorber. By exposing the absorbent to the stream containing oxygen the absorbent can be regenerated as required. An effluent can be withdrawn from the absorbent zone which contains a low content of $H_2S$. The $SO_2$ liberated during regeneration can be reacted with materials in the spent shale to form a solid substance which can be withdrawn from the retort along with the spent shale.

DETAILED DESCRIPTION OF THE INVENTION

Figure 1:
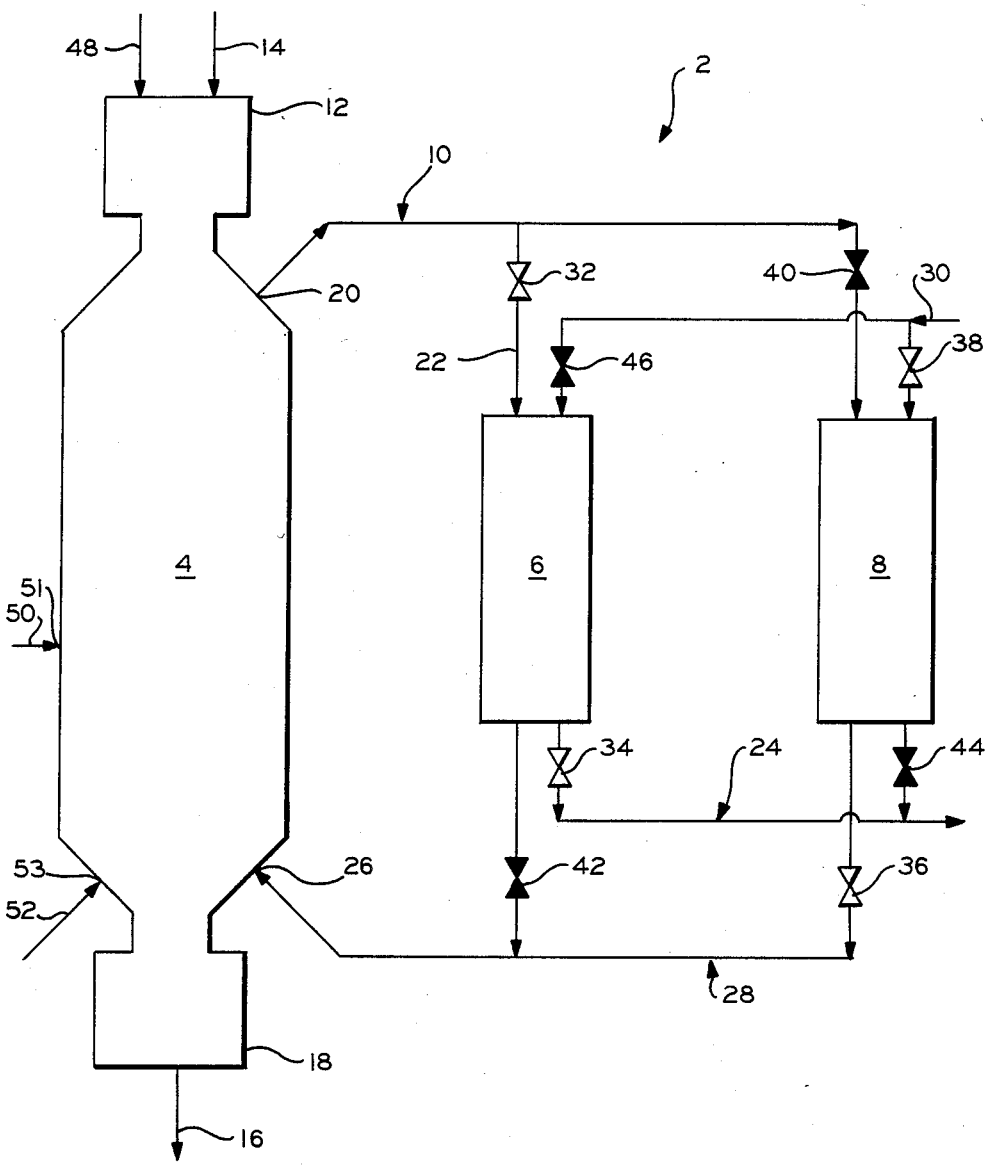
FIG. 1 schematically illustrates certain features of one embodiment of the invention.

It is believed that the hydrogen sulfide is being absorbed by the absorbent composition and thus the term "absorption process" and "absorbent composition" are utilized for the sake of convenience. However, the exact chemical phenomenon occuring is not the inventive feature of the process of the present invention and the use of the term "absorb" in any form is not intended to limit the present invention.

According to an embodiment of the invention, an apparatus 2 comprises a reactor such as a retort 4, an absorber 6 and a desorber 8. The reactor 4 is capable of emitting $H_2S$ and forms a means for providing an effluent stream 10 containing $H_2S$. The stream 10 is withdrawn from an outlet 20 near the first end 12 of the retort. A fresh or raw oil shale stream 14 is introduced into the retort in an inlet near the first end. A spent shale stream 16 is withdrawn from an outlet near a second end 18 of the retort. Where the retort 4 is of the vertical downflow type it will have an upper end which corresponds with the first end 12 and lower end which corresponds with the second end 18. For hydrogen-enriched retorting, which is preferred, it is preferred that the retort be of the vertical downflow type.

The absorber 6 is connected to the outlet 20 by a conduit means 22. The absorber 6 provides a means for absorbing the hydrogen sulfide from the reactor effluent stream 10. The absorber 6 will generally contain a bed of absorbent, usually a fixed particle bed, although the invention may also be practiced with fluidized beds, moving beds, and entrained beds, for example. Preferably, the particle bed is formed from a composition comprising zinc and titanium. Most preferably, the zinc and titanium are combined in the form of zinc titanate. Where the zinc titanate contains at least one promoter selected from the group selected from vanadium, chromium, manganese, iron, cobalt, nickel, molybdenum, rhenium and compounds thereof, hydrogen sulfide present in the effluent stream will be absorbed and organic sulfur compounds which may be present in the stream can be converted to hydrogen sulfide which is subsequently absorbed. Where unsaturated compounds such as olefins are present in the effluent from the retort in addition to excess hydrogen, zinc titanate-containing compositions act as a hydrogenation catalyst to hydrogenate the olefin components to paraffins. Where selection is made of zinc titanate as the absorbent composition, an effluent stream 24 withdrawn from the absorption zone 6 will be lower in hydrogen sulfide content than incoming stream 10 and may also be upgraded to contain a lower concentration of organic sulfur compounds and olefinically unsaturated compounds than the incoming stream 10.

The desorption zone 8 is connected to an inlet 26 near the lower end 18 of the retort 4 by a conduit means 28 which forms a flow path for a stream of sulfur dioxide containing gas from the desorber 8 to the retort 4. The desorber 8 contains a particulate absorbent composition which is usually the same type as is present in the absorption zone 6 and containing previously absorbed hydrogen sulfide. The desorption zone 8 is connected to a source of oxygen-containing gas, for example, a line 30, which usually contains air or preheated air at elevated pressure. Sulfur deposits are burned from the support material in the desorption zone 8, forming $SO_2$, which is introduced into a lower portion of the retort 4 via the inlet 26. In this manner, the absorbent material for the absorbent zone can be regenerated. Where the zones 6 and 8 are fixed beds of particulate material and gas flow is generally downwardly, the beds 6 and 8 can be brought on line alternately in absorption and desorption cycles by the manipulation of valves positioned to connect or disconnect the zones 6 and 8 with the lines 10, 24, 28 and 30. For example, where valve 32 in the conduit means 10, 34 in the conduit means 24, 36 in the conduit means 28 and 38 in the conduit means 30 are open and valve 40 in the conduit means 10, 42 in the conduit means 28, 44 in the conduit means 24 and 46 in the conduit means 30 are closed, the zone 6 is on an absorption cycle from the retort and the zone 8 is on desorption cycle to the retort. By closing valves 32, 34, 36 and 38 and opening valves, 40, 42, 44, and 46 the zone 6 would be placed on desorption or regeneration cycle and the zone 8 would be on absorption cycle. Besides the embodiment of the invention in the drawing, it will be readily apparent to one of ordinary skill that the zones 6 and 8 can be portions of a continuous process using a loop flow of absorbent in a continuous fashion between adsorption and desorption zones, such as transfer line or moving bed units.

Conveying the $SO_2$ from the desorber to the retort provides certain process advantages. The $SO_2$ reacts with materials in the spent shale and results in the production of a solid reaction product easily disposed of. Additional carbon recovery is also realized. According to one reaction mechanism, the $SO_2$ reacts with the residual carbon to form a mixture of carbon monoxide, carbon dioxide and sulfur. The sulfur reacts with iron salts to form iron sulfides. Where calcium and magnesium oxides are present in the spent shale the sulfur dioxide may react with them to form solid calcium and magnesium sulfates, thionates, thionites, or similar salts.

Eastern oil shale is generally rich in pyrite, which is converted in the pyrolysis zone to a form reactable with $SO_2$. Western oil shale is generally rich in dolomite, which is converted during the combustion of the residual carbon on the spent shale to a form reactable with $SO_2$. Where the oil shale is deficient in compounds convertible to reactable materials, such as calcium and magnesium oxide, precursors of these materials, such as dolomite, can be introduced into the retort together with the crushed particulate shale. For example, a stream 48 of dolomite or calcium or magnesium oxide or calcium or magnesium hydroxide or pyrite can be introduced into an inlet near the upper end 12 of the retort 4 together with the shale stream 14.

A stream of oxygen containing gas 52 is introduced adjacent the lower end 18 of retort 4 via an inlet 53 for the combustion of residual carbon. The maximum temperature in the retort, generally in the range of from 900° to 1400° F. occurs above the inlet 53. Usually a temperature of at least 1100° F. is used. Gas flow through the retort 4 is upwards, countercurrent to the downward flow of oil shale. As the shale descends, it is contacted by the hot upwardly rising gas and liberates vapors which are withdrawn from the retort via the outlet 20. To prevent the loss of thermal energy by the discharge of hot shale, oxygen or other cool gas is introduced into the retort 4 through an inlet 53 adjacent the lower end 18 of the retort. For example, a stream of air or oxygen enriched gas 52 can be introduced into the retort 4 at inlet 53 to cool the hot descending shale to a suitable discharge temperature.

Where hydrogen is introduced into the retort via the inlet 51, hydrogen partial pressure in the retort will generally be maintained in the range of from 200 to 2000 psi, usually above 500 psi. Total retort pressure may range from 300 psi upwards to 3000 psi. The hydrogen-containing gases flow from the inlet 51 upwards to the outlet 20. The sulfurous gases introduced into the retort via the inlet 26 flow upwardly toward the outlet 20 until the sulfur dioxide introduced via inlet 26 contacts a reactable material with which it can react at the temperature to which it has been heated by flowing countercurrently to the hot downwardly descending spent shale. Sometimes liquid sulfur will be formed.

A preferred asborbent composition comprises zinc titanate which has been promoted with cobalt oxide and molybdenum oxide. Preferably, the cobalt:molybdenum atomic ratio is in the range of 0.3:1 to about 0.8:1. The zinc titanate base may be made by intimately mixing suitable portions of zinc oxide and titanium dioxide, preferably in a liquid such as water, and calcining the mixture in a gas containing molecular oxygen at a temperature in the range of from about 800° C. to about 850° C. The titanium dioxide used in preparing zinc titanate preferably has a very fine particle size to promote intimate mixing of the zinc oxide and titanium dioxide such as flame hydrolyzed titanium dioxide which has an extremely small particle size.

Generally speaking, the promoter will be present in the absorbing composition at a concentration in the range of 0.4 to 16 wt.% based on weight of the promoted absorbent composition. Where more than one promoter is present, the combined concentration will generally be in the range of from about 1 to about to about 28 wt.% based on weight of the promoted absorbent composition. The concentration of rhenium when used will generally be in the range of from about 0.05 to about 2.5 wt.% based on the weight of the promoted absorbent composition.

The absorption zone can be maintained at a temperature in the range of from about 149° C. to about 538° C. and will more preferably be in the range be in the range of from about 204° C. to about 399° C. where zinc titanate is used as the absorbent. The regeneration cycle where zinc titanate is used as the absorbent will generally be in the range from about 370° to about 815° C. A temperature of about 540° C. is preferred to affect the regeneration within a reasonable time. If desired, an oxidation promoter can be used with the zinc titanate absorbant. Suitable oxidation promoters can be selected from ruthenium, rhodium, palladium, silver, tungsten, iridium and platinum.

The residence time of the retort effluent stream in the absorbent bed expressed in volumes of gas at standard temperature and pressure per volume of absorbent composition per hour is generally in the range of from about 10 to about 10,000 for zinc titanate absorbent and will more preferably be in the range from about 250 to about 2500. The particle size of the absorbing composition will generally be in the range of from about 1 to about 25 millimeters for a fixed bed of zinc titanate absorbent.

That which is claimed is:

1. A process comprising:

(a) pyrolizing an oil shale under conditions to form a spent shale stream containing at least one component reactable with sulfur dioxide and an effluent gas stream containing hydrogen, hydrogen sulfide, hydrocarbons, organic sulfur compounds and organic nitrogen compounds;

(b) passing the effluent gas stream through an absorbent bed;

(c) absorbing said hydrogen sulfide from said effluent gas stream in the absorbent bed;

(d) regenerating the absorbent bed with an oxygen-containing gas stream to form an off-gas stream containing sulfur dioxide; and (e) passing the off-gas stream into contact with the spent shale stream for reaction of the sulfur dioxide in the off-gas stream with the at least one component in the spent shale stream reactable with sulfur dioxide and the formation of sulfur-containing reaction products.

2. A process as in claim 1 wherein the absorbent bed is formed from particles of a composition which comprises zinc and titanium.

3. A process as in claim 2 wherein the absorbent bed comprises zinc titanate particles.

4. A process as in claim 3 wherein the zinc titanate particles are promoted with at least one promoter selected from the group consisting of vanadium, chromium, manganese, iron, cobalt, nickel, molybdenum, rhenium and compounds thereof.

5. A process as in claim 3 in which the effluent stream is withdrawn from an oil shale retort and the off-gas stream is introduced into the oil shale retort, said process further comprising introducing crushed oil shale into the retort, introducing molecular hydrogen containing gas into the retort; and introducing molecular oxygen containing gas into the retort.

6. A process as in claim 5 further comprising introducing dolomite into the retort together with the oil shale; circulating the oil shale and dolomite through the retort in a generally downwardly moving column; withdrawing the effluent gas from the retort adjacent an upper end of the column; introducing the off-gas from the absorbent bed into the retort adjacent the lower end of the column; introducing the oxygen containing gas into the column through an oxygen inlet near the lower end of the column; and introducing the hydrogen containing gas into the column through an inlet between the oxygen inlet and the upper end of the column.

7. A process as in claim 6 wherein sufficient hydrogen is introduced into the retort so as to maintain a hydrogen partial pressure in the effluent from the retort in the range of from about 200 to about 2000 psig; wherein the retort total pressure is in the range of from 300 to 3000 psig; and wherein the oil shale passes sequentially through a pyrolysis zone, a combustion zone, and a cooling zone, wherein the pyrolysis zone has a temperature in the range of from about 750° to about 950° F.; wherein the combustion zone is located beneath the pyrolysis zone and has a maximum temperature of at least 1100° F.; and wherein the cooling zone is located beneath the combustion zone and the spent shale is cooled therein to a temperature sufficiently low for reaction with the sulfur dioxide containing off-gas from the absorbent zone to produce a solid product.

* * * * *